United States Patent [19]

Mayer

[11] Patent Number: 4,529,295

[45] Date of Patent: Jul. 16, 1985

[54] ELECTROPHOTOGRAPHIC COPYING APPARATUS INCLUDING A SELF-CLEANING DEVELOPING ASSEMBLY AND METHOD

[75] Inventor: Edward F. Mayer, San Jose, Calif.

[73] Assignee: Ricoh Company Ltd., Tokyo, Japan

[21] Appl. No.: 510,074

[22] Filed: Jun. 30, 1983

[51] Int. Cl.[3] ..... G03G 21/00

[52] U.S. Cl. ..... 355/15; 430/103; 118/647

[58] Field of Search ..... 355/3 DD, 10, 15, 77; 118/651, 652, 661, 647, 648; 430/103, 117–119, 125

[56] References Cited

U.S. PATENT DOCUMENTS 2,784,694 3/1957 Crumrine ..... 430/103
3,284,224 11/1966 Lehmann ..... 355/3 DD
4,045,217 8/1977 Fujimura ..... 430/103
4,278,343 7/1981 Kurokawa ..... 430/103

*Primary Examiner*—A. T. Grimley
*Assistant Examiner*—Carl Romano
*Attorney, Agent, or Firm*—Flehr, Hohbach, Test, Albritton & Herbert

[57] ABSTRACT

An assembly for developing a latent electrostatic image formed on the photosensitive outer surface of a rotating developing drum making up a part of an electrophotographic copying apparatus is disclosed herein. This assembly includes a supply of developer contained within a housing adjacent the drum, a series of electrodes acting on the developer to aid in developing the electrostatic image, and an arrangement cooperating with the electrodes for cleaning the latter of developer deposited thereon during the development process.

10 Claims, 4 Drawing Figures

ELECTROPHOTOGRAPHIC COPYING APPARATUS INCLUDING A SELF-CLEANING DEVELOPING ASSEMBLY AND METHOD

The present invention relates generally to electrophotographic copying apparatus and more particularly to a specifically designed self-cleaning type of assembly for developing a latent electrostatic image formed on the outer surface of a developing drum making up part of the overall apparatus.

A known type of electrophotographic apparatus described includes a rotatable drum having a photosensitive outer circumferential surface and means for rotating the drum in a controlled fashion so that its outer circumferential surface defines a fixed annular path of movement. This apparatus produces copies from a given electrostatic latent image corresponding to the particular information to be copied on the photosensitive outer circumferential surface of the drum. Thereafter, the latent image formed is developed by means of toner particles which are applied to the image bearing surface in a particular way. Finally, the applied toner is transferred from the drum to a blank sheet for transforming the latter to the desired copy.

Of particular relevance to the present invention is the developing station used in the known electrophotographic apparatus described above. This station includes a reservoir of developer and a number of components including two developing rollers which act on the developer in order to bring the latter in contact with the drum's photosensitive outer surface.

While the developing station just described is generally satisfactory for its intended purpose, it is an object of the present invention to provide a different type of station, specifically one having a self-cleaning feature.

A more particular object of the present invention is to provide a developing station which utilizes a series of electrodes designed to cooperate with developer for developing a latent electrostatic image and an uncomplicated and reliable arrangement for cleaning these electrodes of developer deposited thereon during the development process.

Another particular object of the present invention is to provide the cleaning procedure just recited continuously throughout the developing process.

As will be described in more detail hereinafter, and in accordance with the objective just recited, an assembly for developing a latent electrophotographic image formed on the photosensitive outer surface of a rotating developing drum of an electrophotographic copying apparatus is disclosed herein. This assembly comprises means for containing a supply of developing material including electrically charged toner particles in close proximity to an outer surface segment of the drum as the latter moves through its path of rotation. The assembly also comprising an electrode arrangement configured to cooperate with the developing material for depositing the toner particles on the electrostatic image in order to develop the latter. This arrangement includes a plurality of elongated, parallel and closely spaced electrodes and means supporting the latter in operating positions adjacent the developing drum's outer surface. A continuous stream of developing material is directed from the supply along a path extending between the electrodes and the outer surface of the drum as the latter rotates in order to cause toner particles within the stream to develop the image. To this end, the image itself, the electrodes and the toner particles are appropriately electrically biased.

In accordance with the present invention, the overall assembly just described includes means for cleaning the electrodes just mentioned of any toner particles deposited thereon during the development process. To this end, the electrodes are moved in a specific way to engage the cleaning means. In one embodiment, the electrodes are continuously rotated about their respective elongated axes in engagement with the cleaning means, while otherwise remaining in their operating positions. In another embodiment, the electrodes are moved laterally away from the developing drum's outer surface and then rotated about their respective axes to specific cleaning positions. Both of these embodiments will be described in more detail hereinafter in conjunction with the drawing, wherein:

Figure 1:
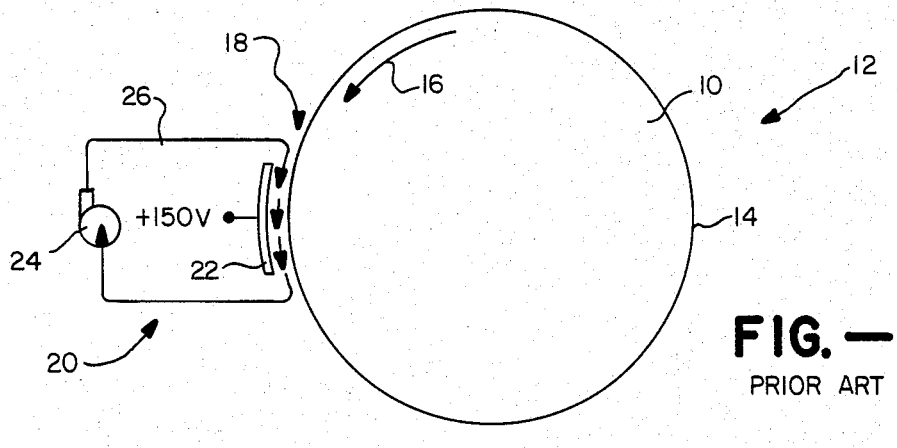
FIG. — 1 PRIOR ART
FIG. 1 is a diagrammatic illustration of an assembly designed in accordance with the prior art for developing a latent electrostatic image formed on the photosensitive outer surface of a rotating developing drum making up part of an electrophotographic copying apparatus.

Turning first to FIG. 1, a rotatable developing drum 10 forming part of an overall electrophotographic copying apparatus generally indicated by the reference numeral 12 is illustrated. The drum includes a photosensitive outer circumferential surface 14 and means (not shown) for rotating the drum in a controllable manner so as to cause surface 14 to move along a fixed annular path in the direction of arrow 16, through a charging station, an exposure station, a developing station, a transfer or copy forming station and, finally, a drum cleaning station. Only the developing station, which is generally indicated at 18, is illustrated.

In actual operation, drum 10 is caused to rotate in the direction of arrow 16 for moving surface 14 first through the charging station where the surface is electrically charged to a suitable level and, thereafter, through an exposure station in order to form an electrostatic latent image conforming to the original being copied. The electrostatic latent image thus formed is then moved through developing station 18 which, as will be described below, includes a heretofore known type of assembly 20 for developing the image with toner particles. Thereafter, the developed image moves through the transfer station for actually making the ultimate copy. Finally, the drum surface moves through the cleaning station during which a residual toner is removed therefrom.

Still referring to FIG. 1, developing assembly 20 is shown including a plate electrode 22 which extends the length of and parallel with the axis of drum 10 in close proximity and in confronting relationship with an outer surface of the drum. The electrode is biased with a positive voltage, for example, the +150 volts illustrated. The selection of this biased voltage presupposes that the electrostatic image on drum 14 is also positively charged, and that the toner particles used, to be discussed below, are negatively charged. Obviously, these polarities could be reversed. Assembly 20 also includes developing material, for example, the negative toner particles just mentioned, in a liquid carrier system. A pump 24 and cooperating conduit means are provided for directing a continuous stream of this developing system along a path between electrode 22 and its confronting segment of drum surface 14, as indicated by the arrows 26 in FIG. 1. As this stream moves between the plate electrode and rotating drum, its proximity with the electrostatic image on the rotating drum surface causes the toner particles within the developer system to deposit on the image for developing the latter. However, at the same time, because of the positive voltage bias on the electrode plate (which is necessary to insure that the non-image areas on the drum surface are not developed), some of the toner particles within the developing system tend to collect on the plate electrode itself. Eventually, operation of the overall apparatus must be temporarily suspended in order to clean the electrode of toner buildup thereon.

Figure 2:
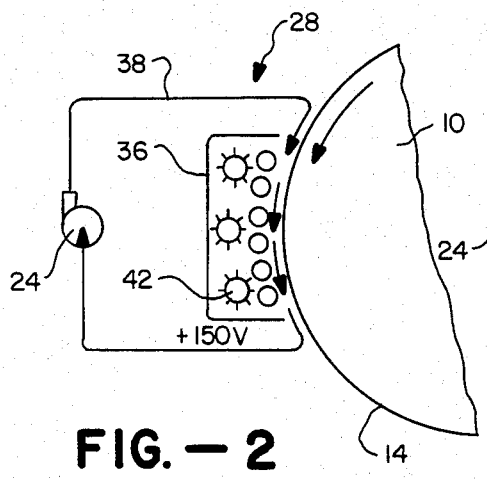
FIG. 2 is a diagrammatic illustration of a developing assembly designed in accordance with one embodiment of the present invention.
Figure 3:
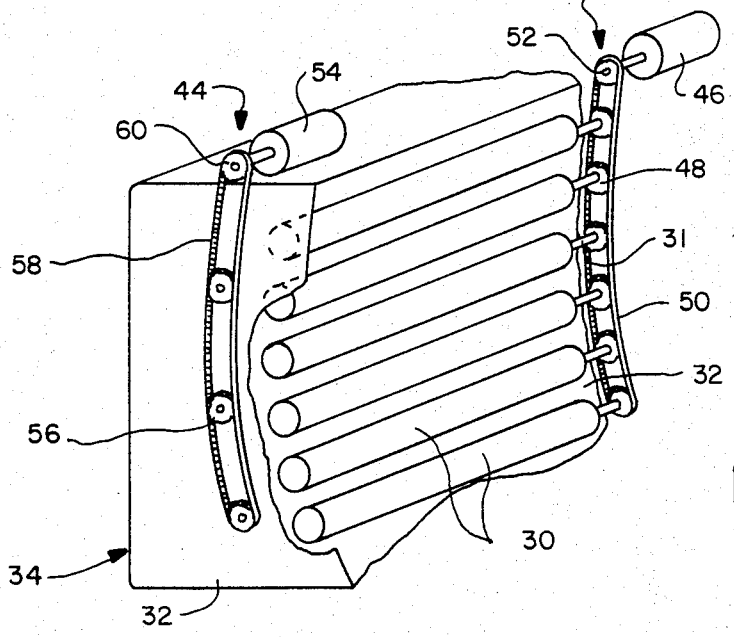
FIG. 3 is an enlarged prospective view illustrating a part of the assembly of FIG. 2.

In order to reduce and preferably eliminate operational shut down of apparatus 12 for cleaning its developing electrodes as described, the present invention provides a developing assembly 28, as illustrated in FIGS. 2 and 3.

As seen in these figures, the assembly includes a series of elongated, cylindrical elctrodes 30 which are located relatively close to one another in parallel relationship with the axis of drum 10 and in close confronting relationship with the drum's outer surface. In other words, the cylindrical electrodes, together, are in essentially the same position relative to developing drum 10 as previously described plate electrode 22. As best seen in FIG. 3, these electrodes are individually supported for rotation about their respective axes by the opposite side walls 32, forming part of an overall support housing 34. To this end, each cylindrical electrode includes bearing pins 38 which extend out from opposite ends thereof, and which cooperate with the side walls 32 of housing 34 to allow the electrode to rotate.

Like previously described assembly 20, developing assembly 28 includes means containing a supply of the previously described developing material including charged toner particles and the previously described pump 24 or other suitable means for directing a continuous stream of the developing material from its supply along a path extending between the cylindrical electrodes and the outer surface 14 of drum 10 as the drum rotates, as indicated by arrows 38, in order to cause the toner particles within the stream to develop the image carried on the drum. To this end, the cylindrical electrodes are biased with positive voltage, for example, the +150 volts indicated in FIG. 2. Like assembly 20, this presupposes that the electrostatic image is positively charged to greater voltage, while the toner particles are negatively charged.

From the foregoing discussion of assembly 28 and assuming the individual electrodes 30 remain stationary during the developing procedure, e.g., in their respective operating positions illustrated, the surfaces of the electrodes in direct confronting relationship with the drum will accumulate toner particles in the same manner as previously described electrode 22. However, in accordance with the present invention, assembly 28 includes an arrangement for cleaning the electrodes of accumulated toner particles. This arrangement uses an electrode drive mechanism generally indicated at 40 for rotating the cylindrical electrodes about their respective longitudinal axes in a controlled manner to be described below, a series of cylindrical cleaning brushes 42 and a drive mechanism 44 for rotating the brushes around their respective axes in a controlled manner.

As best illustrated in FIG. 3, mechanism 40 includes a drive motor 46 powered by suitable means not shown, a series of sprockets 48 connected to respective bearing pins 31 extending from common ends of the cylindrical electrodes 30, outside support housing 36, and a drive chain 50. The drive chain interconnects sprockets 48 to a drive sprocket 52 which is powered by drive motor 46. In this way, all of the cylindrical electrodes 30 can be rotated about their respective axes simultaneously and is the same direction. As best illustrated in FIG. 2, the cylindrical brushes 42 are disposed in parallel relationship with and behind electrodes 30. In addition, they are supported for rotating about their respective axes to side walls 32 by cooperating bearing pins in the same manner as the electrodes.

In the particular embodiment shown, three such brushes are utilized, one for each pair of electrodes. Each brush is positioned in sufficiently close relationship to its pair of electrodes in order to engage the latter with its bristles. Returning to FIG. 3, drive mechanism 44 includes a drive motor 54, a series of sprockets 56 fixedly connected to adjacent bearing pins of brushes 42, outside one of the side walls of support housing 36, and a drive chain 58. The drive chain interconnects sprockets 56 to motor 54 by means of another drive sprocket 60. In this way, all three brushes can be rotated simultaneously in the same direction.

The overall cleaning arrangement just described can be operated in two different modes, a discontinuous one and a continuous one. In its discontinuous mode, the electrodes 30 and brushes 42 would remain stationary during the developing procedure. Thereafter, either the electrodes or the brushes, or both, would be caused to rotate continuously in order to clean toner particles deposited on the electrodes. In accordance with a second discontinuous mode, the electrodes would be rotated 180° so that the surfaces thereof, which normally confront the drum when the electrodes are in their operating positions, would face the brushes and the latter would be continuously rotated to clean these surfaces. In a continuously operating mode of the cleaning arrangement, the electrodes would be continuously rotated throughout the developing process, and the brushes would either remain stationary or would also rotate. In either case, the electrodes would be continuously cleaned as the developing procedure takes place. Obviously, suitable means (not shown) would be necessary to operate drive mechanisms 46 and 54 at the appropriate times relative to the rest of the operation of the overall copying apparatus.

Having described overall developing assembly 28, attention is directed to a modified assembly 62 which includes a series of elongated electrodes 64 which are positioned relative to one another and to drum surface 14 in the same manner as electrodes 30 and which are supported for rotation along their respective axes, again, in the same manner. The only difference between electrodes 64 and electrodes 30 (besides the fact that only four electrodes 64 are shown) resides in the cross-sectional configuration of each. The electrodes 30 display circular cross-sections, while the cross-section of each electrode 64 is also circular, except for a longitudinally extending flat side 66. Overall assembly 62 also includes a pair of elongated brushes 68 which may be identical to brushes 42. Also, while not shown, assembly 62 includes a mechanism 40 for rotating electrodes 64 about their respective axes and a mechanism 44 for rotating brushes 68 about their respective axes.

Figure 4:
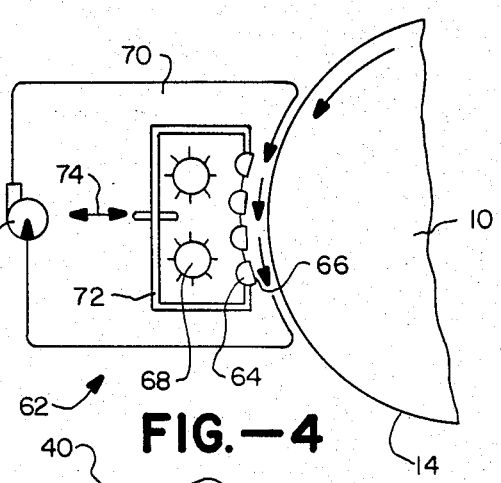
FIG. 4 is a diagrammatic illustration of a developing assembly designed in accordance with a second embodiment of the present invention.

Overall developing assembly 62 is shown in FIG. 4 in its operating position. That is, the electrodes 64 are located close to drum surface 14 with their respective flat surfaces 66 in confronting relationship therewith. At the same time, the assembly includes the previously described supply of developing material including toner particles and pump means 24 for directing a continuous stream of this material from the supply along a path extending between the electrode surfaces 66 and drum surface 14, as indicated by arrow 70. As a result, there is a tendency for toner particles to deposit on flat surfaces 66. However, in accordance with the present invention, the entire support housing for the electrodes, generally indicated at 72, not only supports the electrodes for rotation but is interconnected with the electrodes so as to be able to move the electrodes between their FIG. 4 operating positions and a position laterally away from the drum and into engagement with brushes 68, as indicated by two-way arrow 74. The particular means to accomplish this can be readily provided. Thus, after the developing process ends, the electrodes 64 can be moved laterally (or radially) away from the drum and rotated 180° by mechanism 40. Thereafter, brushes 68 can be rotated by mechanism 44 for cleaning by its surfaces 66. The assembly can then be returned to its operating position.

The lateral movement of the arrangement of electrodes 64 is only necessary if it is desirable to place the flat sides 66 sufficiently close to the drum surface 14 so as not to be able to rotate the electrodes when in this position. If the electrodes are placed in their operating positions sufficiently far from the drum surface to be able to rotate 180° while in these positions, it would not be necessary to move them laterally for engagement with cleaning brushes 68. In this case, the cleaning brushes would be placed closer to the electrodes so that rotation of the latter would place respective flat surfaces in engagement with the brushes.

What is claimed:

1. An assembly for developing a latent electrostatic image formed on the photosensitive outer surface of a rotating developing drum making up part of an electrophotographic copying apparatus, said assembly comprising:

(a) means for containing a supply of developing material including electrically charged toner particles in close proximity to an outer surface segment of said drum, as the latter moves through its path of rotation, said toner particles displaying the opposite electrostatic polarity as said image;

(b) an electrode arrangement configured to cooperate with said developing material for depositing toner particles on said electrostatic image in order to develop the latter, said arrangement including (i) means including a plurality of elongated parallel and closely spaced electrodes electrically biased with a voltage having the same polarity as that of said electrostatic image, and (ii) means supporting said electrodes in operating positions such that they are in parallel relationship with the axis of said developing drum while, at the same time, in close proximity to and in confronting relationship with the drums outer surface;

(c) means for directing a continuous stream of said developing material from said supply along a path extending between said electrodes and the outer surface of said drum as the latter rotates in order to cause toner particles within said stream to develop said image; and (d) means for cleaning said electrodes of toner particles deposited on the surface of said electrodes confronting said outer drum surface during the development of said image, said cleaning means including means for moving said electrodes so as to place said electrode surfaces in cleaning positions out of confronting relationship with said outer drum surface and means for cleaning said electrode surfaces of toner particles when said electrode surfaces are in said cleaning positions;

(e) said electrodes including elongated, flat surfaces which confront said developing drum when said electrodes are in said operating positions and said means for moving said electrodes including means for rotating the electrodes about the respective axes between said operating positions and rotated positions 180° therefrom, said means for moving said electrodes including means for shifting said electrodes as a group between said operating positions and a group positioned generally radially away from said drum, said last-mentioned position in combination with rotated positions defining cleaning positions for said electrodes.

2. An assembly according to claim 1 wherein said developing material includes a liquid carrier for said toner particles.

3. An assembly according to claim 1 wherein said cleaning means includes brush means positioned to engage said electrodes as the latter rotate about their respective axes.

4. An assembly according to claim 3 wherein said brush means includes a sufficient number of elongated brushes parallel with and in close proximity to said electrodes so as to engage all of the latter.

5. An assembly according to claim 4 wherein said cleaning means includes means for rotating said sufficient number of brushes about their respective axes.

6. An assembly according to claim 5 wherein each of said electrodes has a circular cross-section.

7. An assembly according to claim 1 wherein said cleaning means include brush means positioned to engage said flat surfaces of said electrodes when the latter are in said cleaning positions and means for moving said brush means relative to said flat surfaces for cleaning the brushes when the latter is in said cleaning positions.

8. An assembly according to claim 7 wherein said brush means includes a sufficient number of elongated brushes parallel with and in close proximity to said electrodes so as to engage all of the latter.

9. An assembly according to claim 8 wherein said means for moving said brush means include means for rotating said brushes about their respective axes.

10. A method of developing a latent electrostatic image formed on the photosensitive outer surface of a rotating developing drum making up part of an electrophotographic copying apparatus, said method comprising the steps of:

(a) containing a supply of developing material including electrically charged toner particles in close proximity to an outer surface segment of said drum as the latter moves through its path of rotation, said toner particles displaying the opposite electrostatic polarity as said image;

(b) providing an electrode arrangement configured to cooperate with said developing material for depositing said toner particles on said electrostatic image in order to develop the latter, said arrangement including (ii) means including a plurality of elongated, parallel and closely spaced electrodes electrically biased with a voltage having the same polarity as that of said electrostatic image, and (ii) means supporting said electrodes in operating positions such that they are in parallel relationship with the axis of said developing drum while, at the same time, in close proximity to and in confronting relationship with the drums outer surface;

(c) directing a continuous stream of said developing material from said supply along a path extending between said electrodes and the outer surface of said drum as the latter rotates in order to cause toner particles within said stream to develop said image; and (d) claning said electrodes of toner particles deposited on the surface of said electrodes confronting said drum surface during the development of said image, said cleaning step including the step of moving said electrodes so as to place said electrode surfaces in cleaning positions out of confronting relationship with said drum surface and cleaning said electrode surfaces of toner particles when said surfaces are in said cleaning positions;

(e) said step of moving said electrodes including rotating the electrodes about their respective axes while otherwise remaining in said operating positions; and (f) said electrodes including elongated, flat surfaces which confront said developing drum when said electrodes are in said operating positions and said step of moving said electrodes including the step of rotating the electrodes about the respective axes between said operating positions and rotated positions 180° therefrom, and said step of moving said electrodes also including the step of shifting said electrodes as a group between said operating position and a position generally radially away from said drum, said last-mentioned position in combination with rotated positions defining cleaning positions for said electrodes.

* * * * *